US006379292B1

(12) United States Patent
Simhaee

(10) Patent No.: US 6,379,292 B1
(45) Date of Patent: Apr. 30, 2002

(54) CONTINUOUS ROLL OF PLASTIC BAGS

(76) Inventor: Ebrahim Simhaee, 112 N. Maple Dr., Beverly Hills, CA (US) 90210

( * ) Notice: Subject to any disclaimer, the term of this patent is extended or adjusted under 35 U.S.C. 154(b) by 0 days.

(21) Appl. No.: 09/677,931

(22) Filed: Oct. 3, 2000

Related U.S. Application Data

(62) Division of application No. 09/054,446, filed on Apr. 2, 1998, now Pat. No. 6,135,281.

(60) Provisional application No. 60/042,672, filed on Apr. 3, 1997.

(51) Int. Cl.[7] ..... B31B 1/64; B31B 1/76; B31B 1/78

(52) U.S. Cl. ..... 493/276; 493/194; 493/198; 53/385.1

(58) Field of Search ..... 493/8, 24, 194–198, 493/230, 233, 256, 257, 923; 53/384, 385.1, 459, 570, 467–469; 225/47, 77, 80, 90

(56) References Cited

U.S. PATENT DOCUMENTS

| | | | | | |
|---|---|---|---|---|---|
| 3,027,065 | A | | 3/1962 | Lindquist et al. | 383/37 |
| 3,060,075 | A | | 10/1962 | Kincaid | |
| 3,098,594 | A | | 7/1963 | Williamson | 225/48 |
| 3,254,828 | A | | 6/1966 | Lerner | |
| 3,533,331 | A | * | 10/1970 | Kugler | 93/35 |
| 3,727,814 | A | | 4/1973 | Kuckhermann | 225/100 |
| 3,730,411 | A | | 5/1973 | Brockmuller | 225/100 |
| 3,749,237 | A | | 7/1973 | Dorton | 206/438 |
| 3,754,370 | A | | 8/1973 | Hanson | 53/459 |
| 3,979,050 | A | | 9/1976 | Cilia | 229/66 |
| 3,987,603 | A | | 10/1976 | Jelling et al. | 53/459 |
| 4,201,029 | A | | 5/1980 | Lerner et al. | 53/429 |
| 4,306,656 | A | | 12/1981 | Dahlem | 206/390 |
| 4,493,684 | A | | 1/1985 | Bolton | 493/234 |
| 4,498,894 | A | | 2/1985 | Kuckhermann | 493/234 |
| 4,550,831 | A | | 11/1985 | Whitford | 206/439 |
| 4,664,161 | A | * | 5/1987 | Sawa et al. | 141/114 |
| 4,694,638 | A | | 9/1987 | Maddux, Jr. et al. | 53/459 |
| 4,747,815 | A | | 5/1988 | Benoit et al. | 493/194 |
| 4,904,092 | A | | 2/1990 | Campbell et al. | 383/35 |
| 4,997,119 | A | | 3/1991 | Meschi | 225/110 |
| 5,064,408 | A | * | 11/1991 | Bridgeman | 493/194 |
| 5,118,022 | A | * | 6/1992 | Farahnik | 225/106 |
| 5,135,134 | A | * | 8/1992 | Dancy | 221/61 |
| 5,135,146 | A | | 8/1992 | Simhaee | 225/80 |
| 5,141,142 | A | | 8/1992 | Ramsey | 225/4 |
| 5,170,957 | A | * | 12/1992 | Carpenter | 242/55.53 |
| 5,215,275 | A | | 6/1993 | Gold | 242/56.8 |
| 5,219,424 | A | * | 6/1993 | Simhaee | 225/47 |
| 5,261,585 | A | | 11/1993 | Simhaee | 225/47 |
| 5,417,639 | A | | 5/1995 | Cronauer | 493/223 |
| 5,427,294 | A | | 6/1995 | VandenHeuvel et al. | 225/4 |
| 5,433,363 | A | | 7/1995 | Simhaee | 225/47 |
| 5,480,083 | A | | 1/1996 | Achelpohl | 225/100 |
| 5,556,019 | A | * | 9/1996 | Morris | 225/96 |
| 5,558,262 | A | | 9/1996 | Simhaee | 225/106 |
| 5,752,666 | A | | 5/1998 | Simhaee | 242/160.4 |
| 5,921,390 | A | | 7/1999 | Simhaee | 206/390 |

FOREIGN PATENT DOCUMENTS

| | | |
|---|---|---|
| DE | 44 07 761 A1 | 3/1994 |
| WO | WO93/11050 | 6/1993 |

* cited by examiner

*Primary Examiner*—John Sipos
*Assistant Examiner*—Hemant M Desai
(74) *Attorney, Agent, or Firm*—Darby & Darby

(57) ABSTRACT

A continuous web of bags formed of a plurality of layers to be separated along a line of perforations that extends through all of the layers transverse of the web, in which at least one of the outermost layers is detached from the web at the separation line. Apparatus accomplishes this detachment in a moving web by engaging the outermost layer outer surface and exerting a force in a manner to produce the detachment from the separation line. Both the outermost upper and lower web layers can be detached at the separation line.

6 Claims, 7 Drawing Sheets

CONTINUOUS ROLL OF PLASTIC BAGS

"This is a continuation, of application Ser. No. 09/054,446, filed Apr. 2, 1998, now U.S. Pat. No. 6,135,281 . This application is hereby incorporated herein by reference, in its entirety."

This application claims priority pursuant to 35 U.S.C. §119 from U.S. Provisional Patent Application Ser. No. 60/042,672 filed Apr. 3, 1997, the entire disclosure of which is hereby incorporated by reference.

FIELD OF THE INVENTION

The present invention, relates to plastic bags and more particularly, to a roll of plastic bags wherein the bags are partially opened as they are dispensed.

BACKGROUND OF THE INVENTION

In a supermarket or food market, fresh produce is often displayed in bulk, frequently in piles of loose items. Consumers must take a bag from a nearby source, and then select and bag their own fruits and vegetables. Typically, the source of bags is a vertically or horizontally positioned cylindrical roll of flattened multi-ply plastic film bags supplied in continuous strips.

One type of bag used in a roll is the PULL-N-PAK® bag. This comprises a flat tube of plastic material in which the bags are fully gussetted on each side and folded lengthwise to form a star-sealed eight-ply configuration. The bags have a weld for the bag bottom and there is a separation line of perforations adjacent the weld of each bag. The separation line comprises multiple perforations extending through all eight layers of the bag. A slot is placed in the center of the separation line and extends through all of the layers.

The roll of bags is placed in a dispenser, for example, of the type shown in U.S. Pat. No. 5,558,262. The user pulls the first bag over a tongue of the dispenser which engages the slot in the separation line. The front of the next bag is trapped in the gap between the tongue and a finger behind the tongue and is held in the gap. Continued pulling of the first bag produces a force which separates the first bag from the next bag remaining on the roll at the separation line.

A problem with bags provided on a continuous strip is that the user often finds it difficult to open the bag once it has been removed from the strip. The user may even find it difficult to determine which end of the removed bag is the end that opens. The slick finish of the thin film walls of the bag, the static adhesion of thin plastic films and the perforation forces applied to the films in order to provide the separation lines may cause the plies at the opening of the bag to resist separation in which case a user may need two hands to open the bag. This can be a nuisance when the consumer has already selected and is holding items to be placed in the bag.

An object of the present invention is to provide plastic bags which, when supplied in continuous strips, are more easily opened than previous bags.

A further object is to provide a produce bag which is dispensed to the user in a partially opened state.

A further object of the invention is to provide a continuous strip of produce bags on a roll such that removing a leading bag from the roll readily identifies the opening end of an adjacent successive bag on the roll.

An additional object of the invention is to provide a method and apparatus for processing a moving web of multi-ply bags to separate one layer of each bag along a separation line to provide a roll of plastic bags which are easily opened after separation from the roll.

SUMMARY OF THE INVENTION

According to the invention, a roll of plastic bags, having multiple layers, includes at least one outer layer detached at the separation line from the adjacent bags.

In a preferred embodiment of the invention, the bags are provided in the form of a web which is folded so that one longitudinal edge is a fold line. Adjacent bags are separated by a weld and a separation line. An outer layer of each bag is detached at the separation line from the adjacent bags. By the action of pulling a bag, after the slot in the separation line in the remaining layers engages the tongue of a dispenser, the pulling force is transferred from the connected layers of the first bag to the remaining connected layer(s) of the next bag on the roll. The top layer transfers no force to the next bag because it is completely detached from the web at the separation line; likewise, the top layer of the next bag receives no force from the first bag because it is completely detached at the separation line. As a result, after separation of the first bag from the roll, the front of the next bag is automatically partially opened.

It is also possible to detach only the bottom layer, or both the top and bottom layers. In a star-sealed (eight layer) bag, when the top (first) and bottom (eighth) layers are detached, only six layers remain connected. This makes it easier to separate a bag from the roll since only six layers have to be torn and disconnected along the preparation line.

The invention also includes a method and apparatus for detaching one or both of the outer layers as a web of bags is fed from one location to another location. To accomplish this a friction member engages the outer layer of the web to be detached downstream of the weld between two bags of the web while the friction member is moving at a speed greater than the web travel speed. This detaches the engaged layer along the web separation line. In a web where the separation line is upstream of the weld, the friction member engages the outer layer and exerts a drag force or is moved in a direction opposite to that of web travel.

BRIEF DESCRIPTION OF THE DRAWINGS

The foregoing and other objects and advantages of this invention will become apparent to those skilled in the art upon reading the detailed description of a preferred embodiment in conjunction with a review of the appended drawings in which.

DETAILED DESCRIPTION OF THE INVENTION

Figure 1:
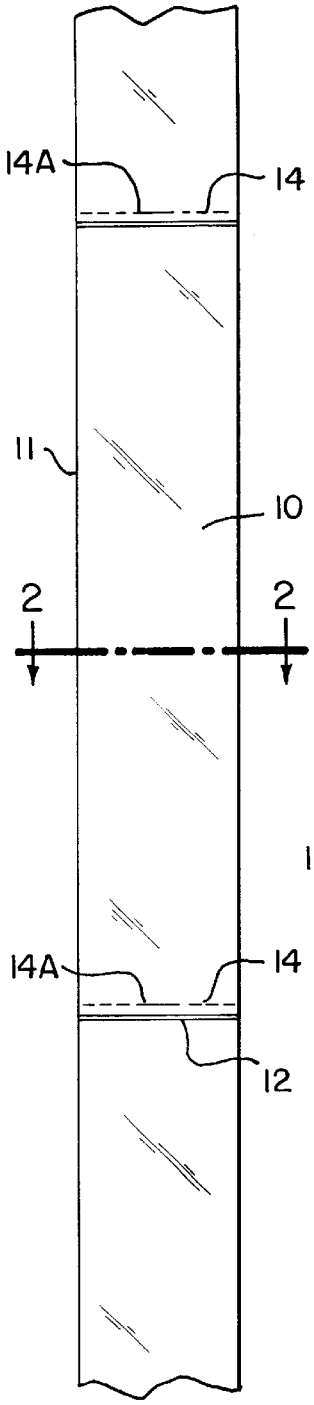
FIG. 1 is a top view of a portion of a continuous strip of bags detailing separation lines between bags.
Figure 2:
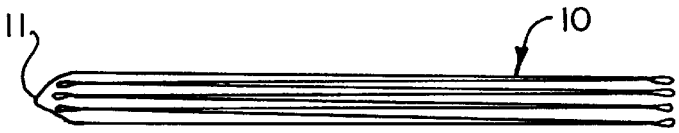
FIG. 2 is a cross-section taken along sectional line 2—2 in FIG. 1, showing the multiple plies of a folded bag.

FIG. 1 shows a continuous strip of plastic bags 10 in accordance with a preferred embodiment of the invention. The bags are provided in what is known as a "star-sealed" configuration which is a standard configuration for plastic bags. It is formed by extruding a tubular form, fully gusseting the form, and then folding the fully gussetted tubular form to form the eight-ply configuration shown in FIG. 2 with one of the longitudinal edges 11 comprising the fold. The individual bags are separated by a weld 12 and a separation line 14, which extend through all eight layers of the star sealed configuration. The weld 12 defines the bottom of a bag and the separation line 14 the top of the adjacent bag.

As described in U.S. Pat. No. 5,558,262, each of the separation lines 14 include a central slot 14A which engages the tongue of a dispenser mechanism to enable the user to separate the individual bags.

Figure 3:
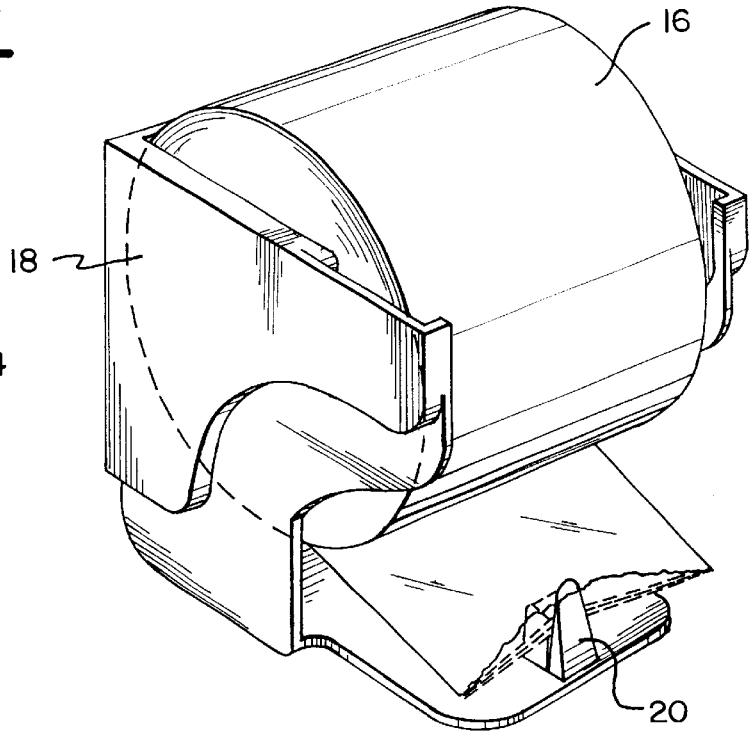
FIG. 3 is a perspective view of a roll of bags in a continuous strip supported in a dispenser.

FIG. 3 shows in perspective form the dispenser mechanism of U.S. Pat. No. 5,558,262. The plastic bags are provided in a roll 16 which includes a central axle (not shown in FIG. 3) which rests in tracks within the dispenser 18. The separating tongue of the dispenser mechanism which engages the slots within the separation line is shown at 20. U.S. Pat. No. 5,558,262 provides a detailed discussion of the construction and operation of the dispenser mechanism in combination with the roll of bags, and is hereby incorporated by reference.

The plastic bag dispensing system described above provides bags in a convenient way for the consumer. After a first bag has been separated from the roll, the next adjacent bag is in place where it can easily be grasped by the user. Moreover, the action of dispensing a given bag tends to open the bag, but if a user has only one hand free or is physically disabled, it can prove difficult to open the bag. When using bags made in accordance with the invention, the bags are automatically partially opened as they are dispensed, which simplifies the task of fully opening the bag to receive produce or other objects. This is accomplished by the simple expedient of completely separating one or both of the outer layers, i.e. the top or bottom layers. In this way, the upper layer (for example) is completely separated from the upper layer of the adjacent bags. As a result, as each individual bag is dispensed, the adjacent bag remaining on the roll is automatically opened.

It is possible to separate the selected layer when the web is stopped for the sealing and/or perforating steps but is preferred to separate the selected layer after sealing and perforating have occurred and while the web is moving continuously.

Figure 4:
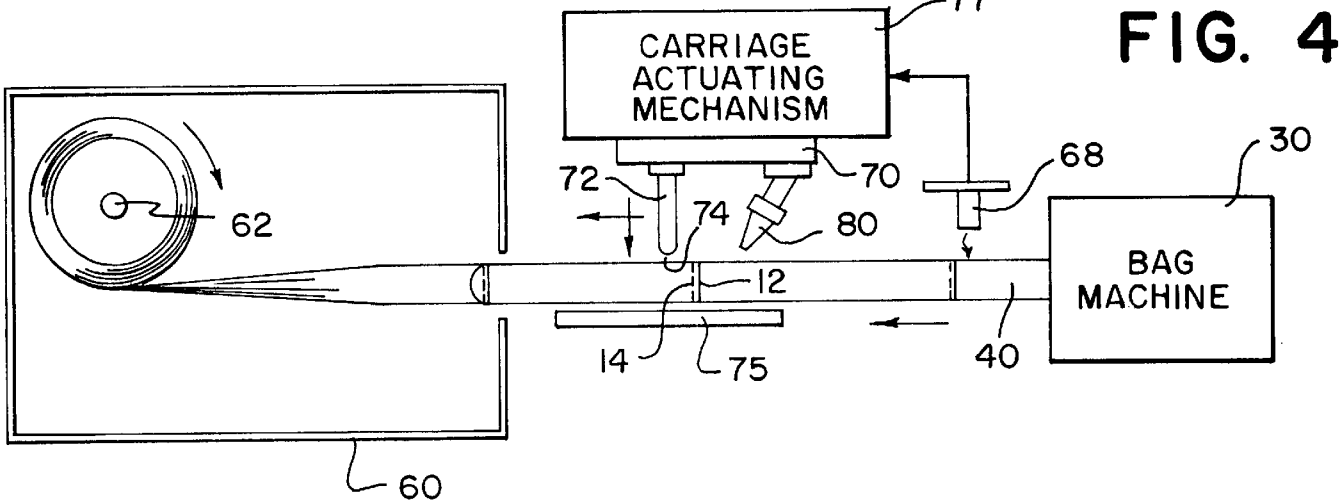
FIG. 4 is a schematic illustration of an apparatus and process for cutting one top layer of the multi-layer bag.

FIG. 4 shows a first way of separating an outer layer of each bag from the adjacent bags as the web is traveling from one location to another. In FIG. 4, reference numeral 30 indicates the machine, of conventional construction, in which the web of bags is made. The bags exit the machine 30 in a continuous web 40 in the configuration shown in FIG. 1. The weld lines 12 are spaced along the length of the web to define the individual bags. The separation lines 14 extend through all of the layers of the web adjacent a corresponding weld line 12. A winding machine 60 is shown for winding the web of bags from the machine 30 into a roll on an axle 62. The web moves in the direction of the arrow, from bag machine 30 to winding machine 60. As shown, the separation lines 14 are downstream, viewed from the exit of machine 30, of the weld lines 12. When the bags are rolled on core 62, the separation lines 14 are upstream of, or behind, the weld lines 12. Obviously, FIGS. 4–7 are schematic views showing the web 40 turned 90° as it moves past the separating mechanism.

A detector 68, such as a photoelectric cell, is located above the web 40. As the web moves, the detector 68 sequentially detects the individual bags by a separation line 14 or a weld line 12.

A carriage 70 is located above the web downstream of the detector. The carriage 70 has a separator in the form of a nib 72 with an end 74 of a high-friction surface, for example, of rubber. The carriage 70 is above a plate 75 over which the web 40 passes. A mechanism 77, such as a piston operated lever, cam or other similar arrangement, first moves the carriage 70 down so that the nib end 74 can contact the upper layer of web material and then moves it for a short distance in the direction of motion of the web but at a speed higher than that of the web. The carriage 70 is operated under control of the detector 68.

In operation, the detector 68 senses the occurrence of the separation line 14, or weld 12, between two bags of the moving web exiting from the machine 30. The carriage 70 is located at a predetermined distance downstream of the detector 68 sufficient to permit the operation of carriage 70 through a complete cycle. That is, upon the detection of the separation line 14, or weld line 12, by the detector 68, mechanism 77 moves the carriage 70 downwardly to bring the nib end 74 into contact with the upper layer of the web a short distance, for example, about one half inch, away from the perforation line 14 in the downstream direction. The carriage 70 and nib 72 are then moved in the same direction as the web travels, but at a higher speed. Due to friction and the higher speed of the nib 72, the web top layer is slid away from the other layers and is detached, or torn, along the perforation line 14 from the top layer of the adjacent bag.

After moving nib 72 a few inches, the carriage mechanism 77 retracts the carriage 70 in the upward direction and returns it to its original position to be ready for the next bag to detach the top layer.

The carriage 70 also has a nozzle 80 that moves with it. The nozzle 80 supplies air that is blown into the pocket formed by the detachment of the top layer from the separation line. Part of the air from nozzle 80 will be trapped between the top layer and the other layers. A thin layer of air reduces the friction between the top layer and the other layers. This makes opening of the bag easier after it is torn from the web. The bag with the outermost layer being open away from the web, as shown at 49, is then rolled onto the roll, preferably in such a way that the open layer will be the top layer when the bags are dispensed.

Figure 5:
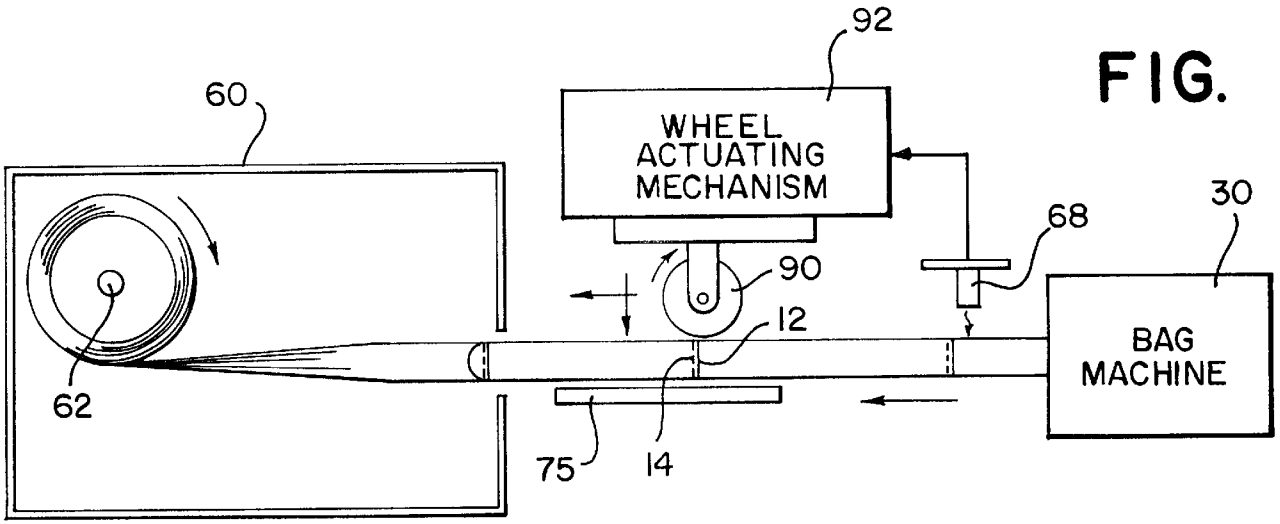
FIG. 5 is a schematic view showing second embodiments of an apparatus and process for cutting the layer.

FIG. 5 shows another embodiment of the invention. The same reference numerals are used for similar components. A separator in this case comprises a rubber wheel 90 located above the web 40 and over the plate 75. The wheel 90 rotates in the same direction as the travel of web 40. In response to a signal from detector 68, a mechanism 92 at the appropriate time causes the wheel 90 to contact the web upper layer. The periphery of wheel 90 moves at a speed faster than the speed of the web. When the wheel 90 rotates at a peripheral speed higher than that of the speed of the web, it detaches the engaged web outer layer along the separation line 14. After the outer layer is detached along the separation line, the wheel 90 is moved out of contact with the web to await the next signal from detector 68. In an alternative form, the wheel 90 can contact the web at all times and be free-rolling so that it does not exert a frictional force sufficient to detach the engaged layer from the perforation line. When it is appropriate to detach the top layer engaged by the wheel from the web, the wheel can be activated to apply a greater engaging force to the outer layer and to rotate at a higher speed. This can be accomplished, for example, by a suitable clutch mechanism.

In one form of the Pull-N-Pak® bags, when the roll is winding, the perforation line 14 is behind, or upstream, of the weld, opposite to what is shown in FIGS. 4 and 5. As a result, as the roll is unwound in the dispenser, the portion of the bag that is trapped in the gap between the finger and the tongue is the closed end of the bag.

Figure 6:
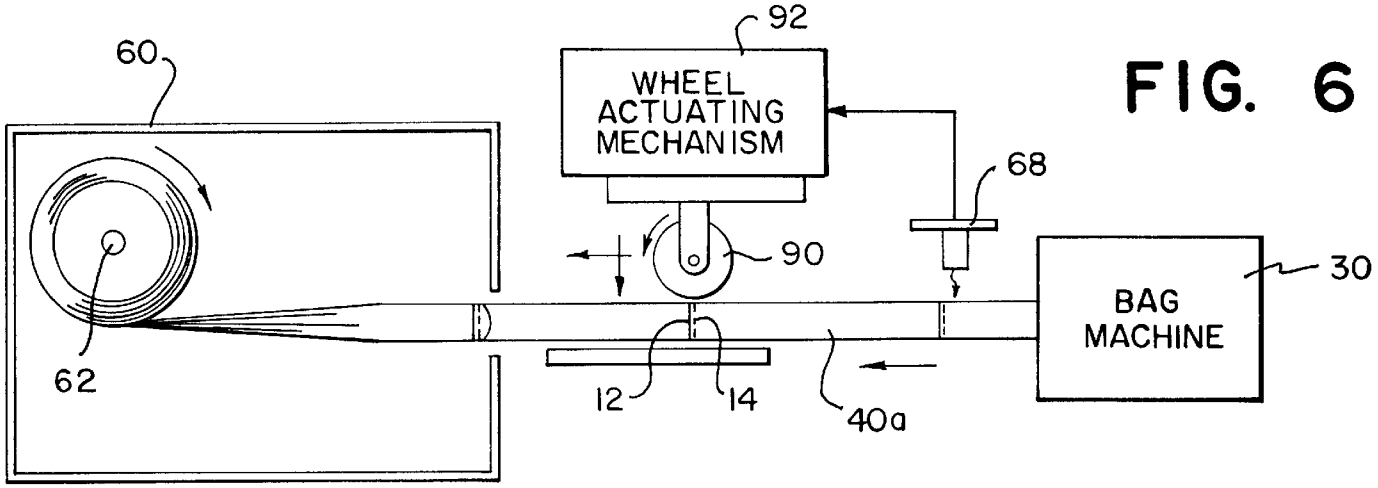
FIG. 6 is a schematic view of a third embodiment.

FIG. 6 shows a web 40*a* of this type and an arrangement for detaching the top layer along the perforation line 14. Here the roller 90 engages the top layer of the bag upstream of the weld line 12. The roller 90 is rotated in a direction opposite to the movement of the web 40 at a speed slower than the movement of the web. This will produce a drag force that will tear the top layer away from the perforation line 14. As an alternative, there can be a series of fingers along a bar that is lowered to engage the web outer layer and held stationary to exert a drag force to detach the outer layer from the web along the separation line.

The mechanism of FIG. 4 also can be used to detach the top layer of a web 40*a* of the type shown in FIG. 6. The nib end 74 would engage the top layer of the web upstream of the separation line 14 and would move toward the bag machine 30 to tear the top layer at the separation line 14.

By changing the position of the carriage mechanism 70 or the wheel 90 from the top of the web to the bottom of the web, the web bottom layer can be detached from the separation line. Also, by providing two stations of detachment one for the top layer and one for the bottom layer, both the top and the bottom layers can be detached from the web separation line. In this case, one station can be spaced from the other, such as one bag length from each other.

Figure 7:
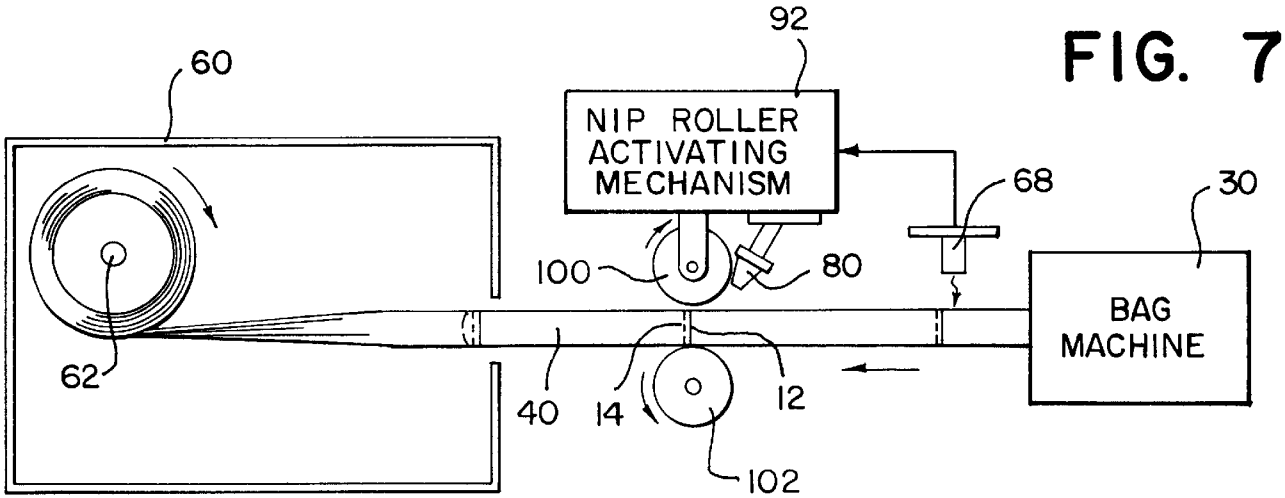
FIG. 7 is a schematic view of a fourth embodiment.

FIG. 7 shows a still further embodiment of the invention. The same reference numerals are used to identify elements which are the same as elements described in FIGS. 4, 5 and 6.

In FIG. 7, a friction wheel 100 is located above the web 40. An adjustable pressure roller 102 is positioned beneath the web 40. Both wheel 100 and pressure roller 102 contact the web 40 and rotate in the direction of travel of the web. Pressure roller 102 is adjustable so that the pressure between the wheel 100 and roller 102 can be adjusted.

The peripheral speed of the pressure roller 102 is equal to the speed of web 40. Likewise, under normal conditions, the peripheral speed of wheel 100 is the same as the speed of web 40. In response to a signal from detector 68, an activating mechanism 92 causes wheel 100 to rotate at a greater peripheral speed than the speed of the web. When this happens, the engaged outer layer of web 40 is detached along the separation line 14. The mechanism 92 activates the wheel 100 at a precise point in time so that the speed of the wheel 100 will be increased at a point in time when it is easiest to detach the separation line 14. Likewise, the period of activation will be the shortest time possible to permit complete detachment of the contacted layer.

As soon as the outer layer has been detached, the peripheral speed of wheel 100 is returned to the speed of the web 40.

Figure 8:
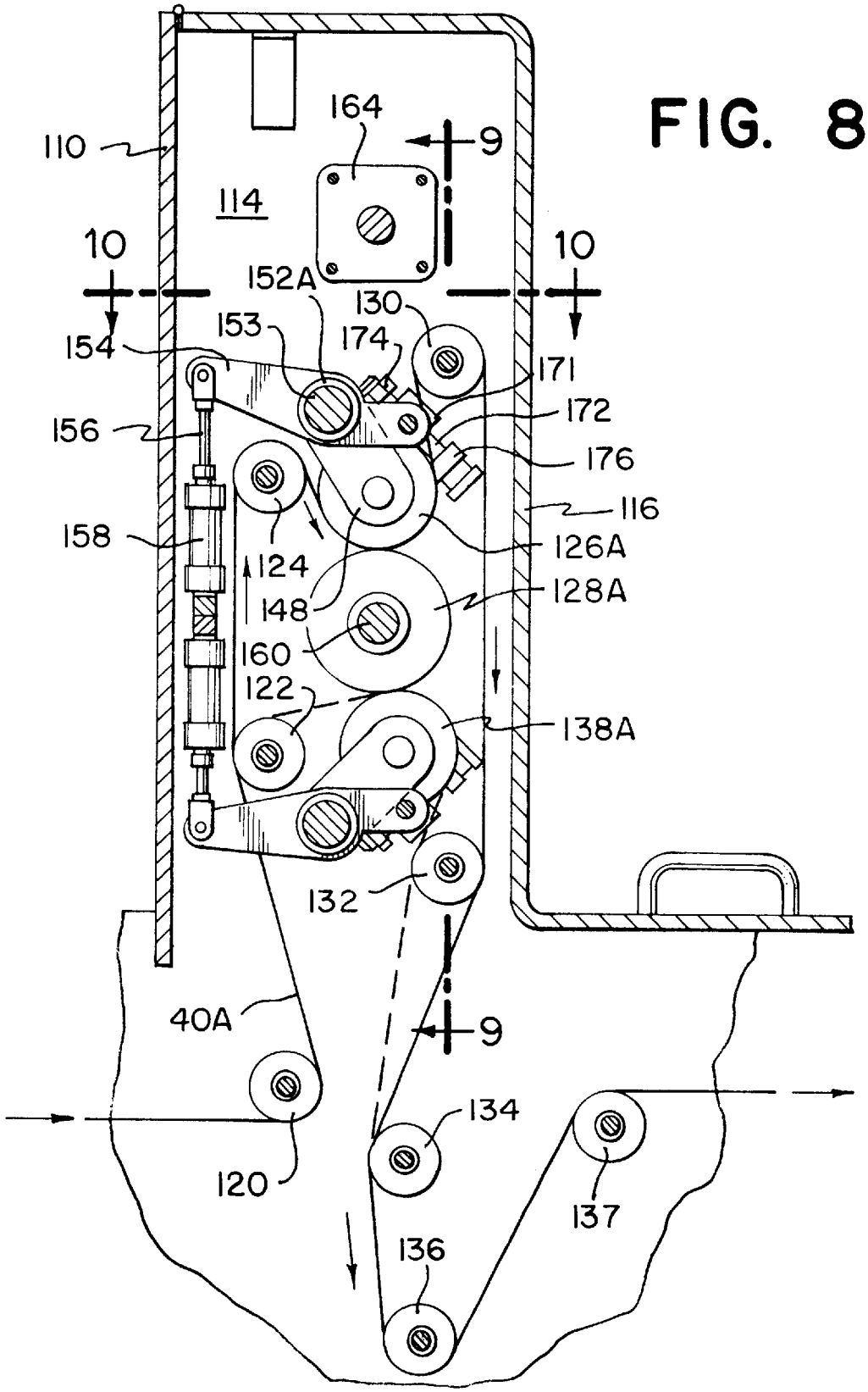
FIG. 8 is a side sectional view of a preferred apparatus used in accordance with the invention taken along the line 8—8 of FIG. 9.
Figure 9:
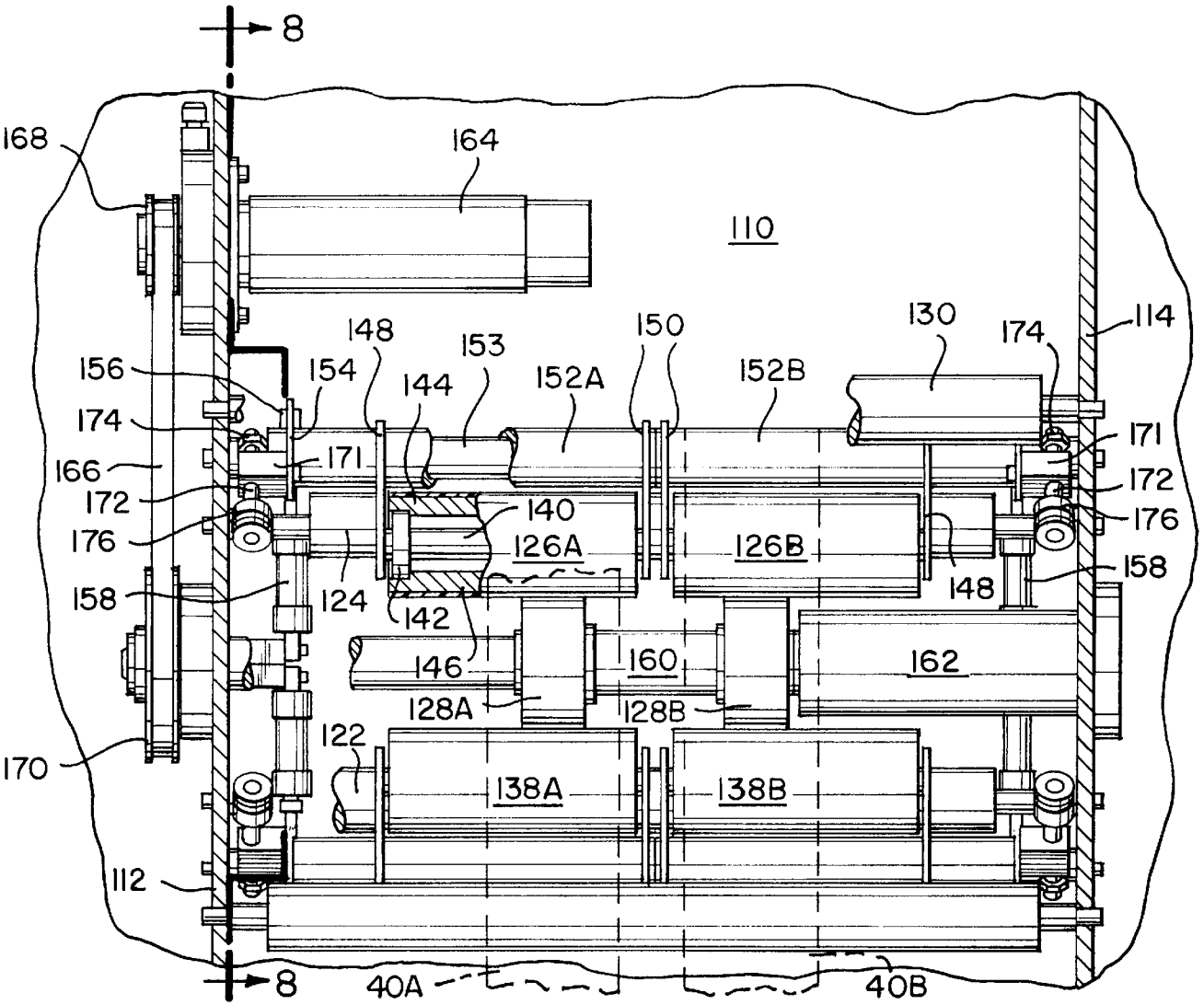
FIG. 9 is a front sectional view along the line 9—9 of FIG. 8.
Figure 10:
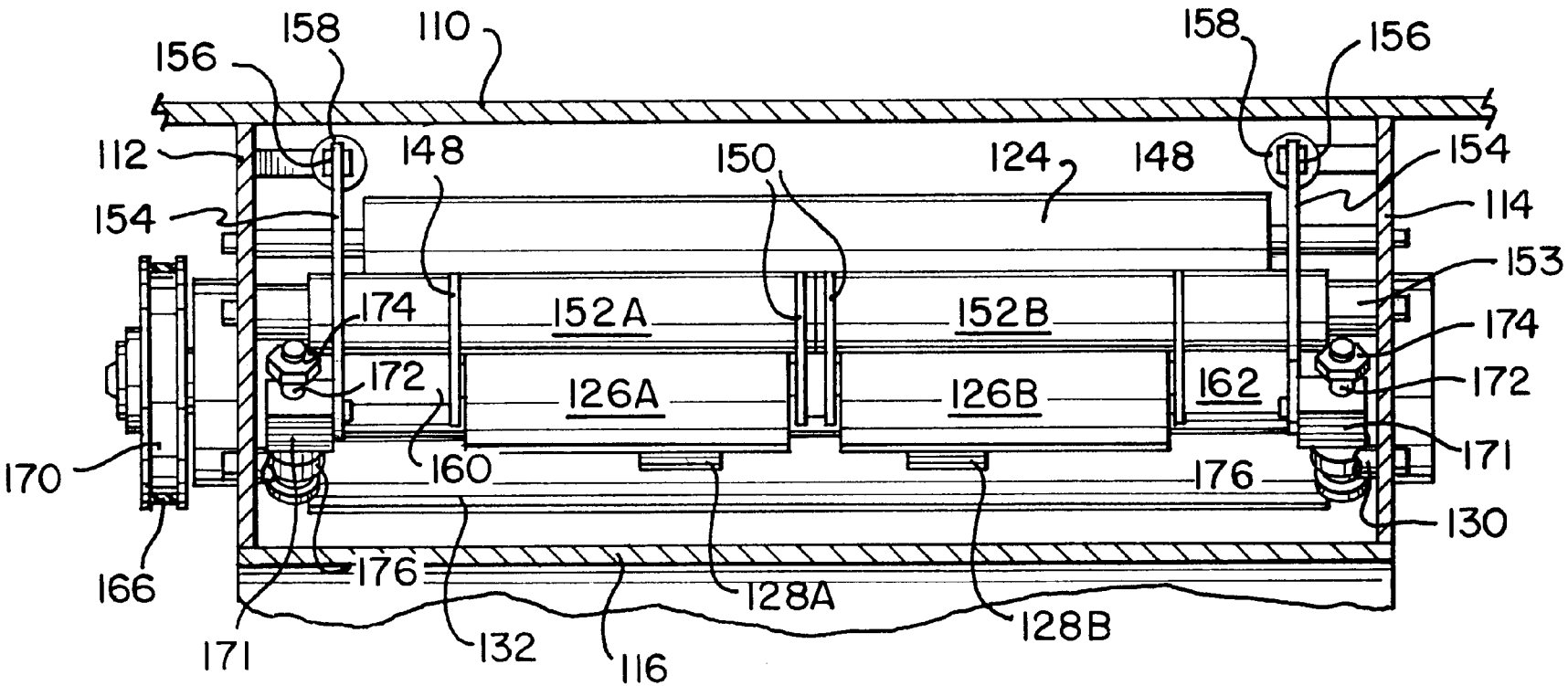
FIG. 10 is a top sectional view along the line 10—10 of FIG. 8.

FIGS. 8–10 show apparatus which can be used to separate either the top or bottom ply of the web as it moves between the bag machine 30 and the take-up roll 62. The web is supplied in the configuration shown in FIGS. 1 and 2, i.e. a fully gussetted, folded (star sealed) film forming eight contiguous layers or plies. One longitudinal edge of the web is formed by a fold and welds 12 and separation lines 14 are provided between adjacent bags. Since the web is being wound by conventional means (not illustrated), it will be under tension. The apparatus shown in FIGS. 8–10 is added to the conventional production line.

The apparatus includes a housing comprising a rear wall 110, side panels 112 and 114, and a removable front cover 116. The various idlers and pressure wheels described below are mounted in the side panels 112 and 114.

As shown in FIG. 9, in the preferred embodiment two lines or webs 40A and 40B pass through the separating mechanism. The operation of both sides of the line is identical. The apparatus includes inlet idlers 120, 122 and 124, upper pressure rollers 126A, 126B and friction wheels 128A, 128B. The actuation of the friction wheels 128A, 128B opens the separation lines 14 in an outer ply of each web as previously described. Outlet idlers 130, 132, 134, dancer roller 136 and idler 137 direct the webs to the winding machine (not shown).

Either the upper or lower layer of a web 40A, 40B can be opened by the apparatus shown in FIGS. 8–10. When the webs pass between the pressure rollers 126A, 126B and friction wheels 128A, 128B, the bottom layers of the webs are opened. As shown in dotted lines, the webs alternatively may be directed from the idler 122 to the pressure rollers 138A, 138B and back to the line past the idler 132. In that case, acceleration of the friction wheels 128A, 128B (in this case, in a counter-clockwise direction) will open the top layer of the bags. It is desirable for the top layer of the web to be the disconnected layer when the bags are dispensed to the customer; therefore, in most cases, the apparatus of FIGS. 8–10 will be used to open the top layer, and the rolls will be wound in a clockwise direction. In some cases, however, it may be preferable to wind the rolls in a counter-clockwise direction in which case the bottom layer of the web would be opened (using the pressure rollers 126A, 126B and friction wheels 128A, 128B) so that when the web is wound counter-clockwise, the open layer is on top.

The structure and operation of pressure rollers 138A, 138B is the same as rollers 126A, 126B which are described below.

Each of the pressure rollers is mounted on an axle 140 with bearings 142 (only one shown) at each end of the respective roller enabling the roller to rotate to accommodate the speed of the moving web. Each roller comprises a steel drum 144 having a rubber coating 146 on its outer periphery. The axle 140, on which drum 144 rotates, is mounted in the free extremities of arms 148 and 150. A pair of sleeves 152A and 152B, which abut against each other, are rotatably mounted on a shaft 153 which is secured in the side panels 112 and 114. The sleeve 152A is attached by arms 148 and 150 to the pressure roller 126A; sleeve 152B is similarly attached to the pressure roller 126B. This enables the pressure in each of the production lines to be independently controlled.

The sleeves 152A, 152B can be rotated to control the pressure applied to each web 40A, 40B as it passes between the pressure rollers 126A, 126B and friction wheels 128A, 128B. For this purpose, a pneumatic pressure control system is provided at each end of the shaft 153. The systems comprise air cylinders 158 and pistons 156 connected at their upper ends to a link 154 which is attached to sleeve 152A or 152B (see FIG. 8). The pistons 156 may be air driven in conventional fashion and serve to control the pressure between the pressure rollers 126A, 126B and friction wheels 128A, 128B, respectively.

The friction wheels 128A and 128B are secured to an axle 160. One end of the axle 160 is suitably journaled within the housing side panel 112 with the other end being journaled within a mounting cylinder 162 connected to the side panel 114. The axle 160 is rotated by servo motor 164 through a belt 166 and pulleys 168 and 170, all of which may be conventional. As explained above with respect to FIG. 7, the servo 164 rapidly accelerates the axle 160 which causes the friction wheels 128A and 128B to open the separation line 14 of the single ply of the web which contacts the friction wheel. Wheels 128A, 128B preferably are made of silicone rubber with a durometer of about 40. This material has been found to be effective in separating a single layer of a multi-layer web.

A mechanism may be provided to limit the movement of the pressure rollers away from the friction wheels 128A and 128B. In FIG. 9, four stop mechanisms are shown each of which may be the same. A cube like block 171 is pivotally attached to the arm 154. A bolt 172 extends through the block 171 and receives a nut 174 at its end. The bolt includes an unthreaded portion which passes through a cylindrical ring 176 which is pivotally attached to the frame panel 112. The position of the nut can be threadedly adjusted to limit the upward (or downward) motion of the associated pressure rollers 126A, 126B (and 138A, 138B).

By way of example only, a typical line speed may be in the range of 460–480 feet per minute. The servo motor 164 may accelerate the pressure wheels 128A, 128B to approximately 150% of the line speed five times each second, which means that for each line the upper plies of five bags can be opened in every second.

In the preferred embodiment, one of the outer plies is separated entirely along the separation line 14. It is also possible that the same principal can be applied during the actual use of the dispenser, whereby one of the outer plies is separated before the user separates the bag from the roll. A structure which can be used for this purpose is shown in FIG. 11.

Timing signals fed to the servo motor are generated by a controller which permits manual fine-tuning of the desired wheel acceleration rate, and an encoder module (not shown) for interpreting signals from the perforation detector 68 (FIG. 7) to effect proper timing. In a preferred embodiment, a modified Unidrive model controller manufactured by Control Techniques, Inc. is used.

Figure 11:
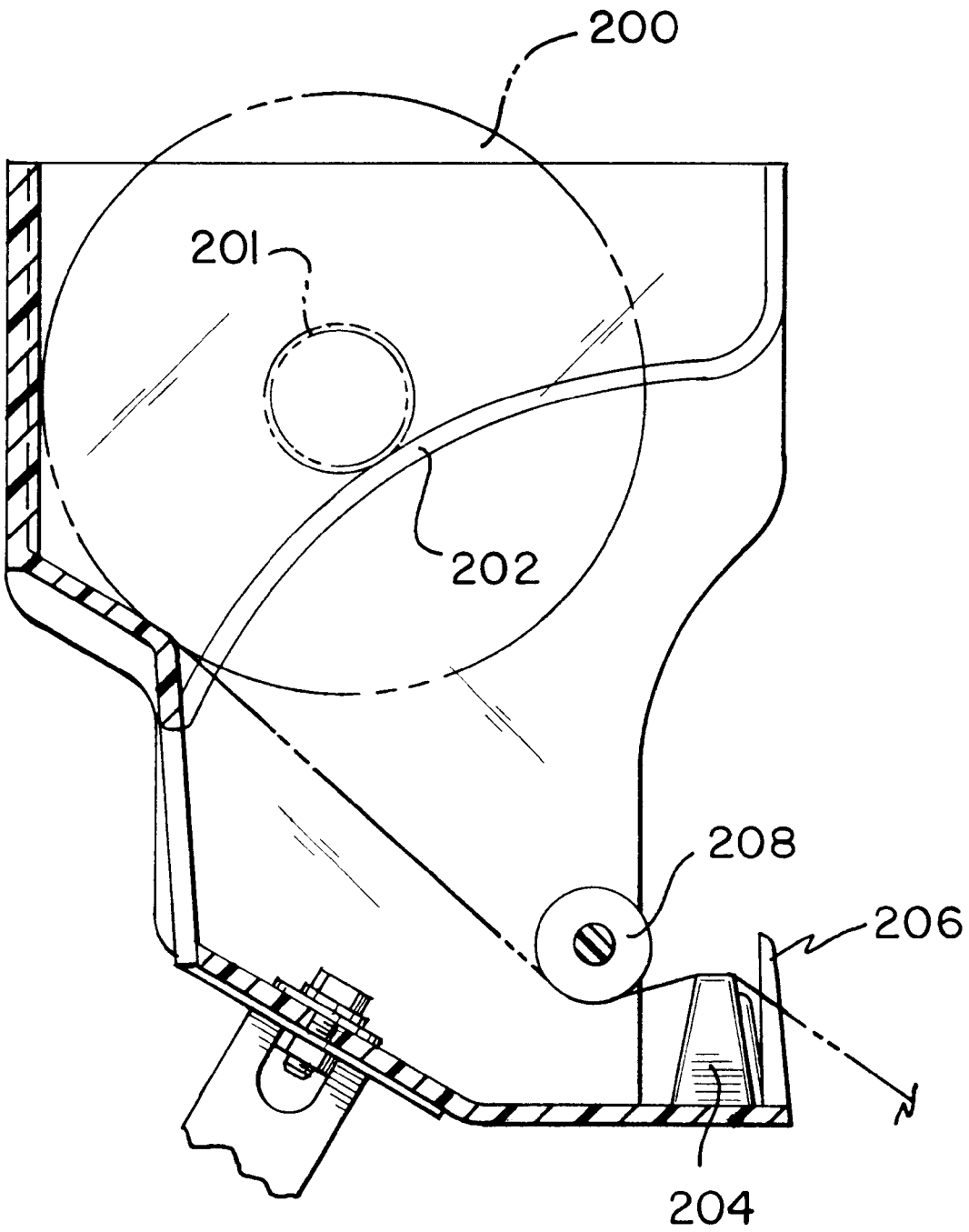
FIG. 11 is a side view partially in section of a dispenser modified to incorporate a friction member for separating the top layer of a multiple ply web as each individual bag is dispensed.

The dispenser shown in FIG. 11 is the same as the dispenser shown in applicant's U.S. patent application Ser. No. 09/036,818 filed on Mar. 9, 1998, attorney docket No. 2669/0D316, and entitled Plastic Bag Dispenser and Support Mechanism Therefore. That application is incorporated herein by reference. The roll of bags is the same as the roll of bags described in this specification and is shown at 200 wound on an axle 201. The axle 201 rides in a pair of tracks 202 and the film is pulled past a finger 204 and a separating tongue 206 which engages the slot 14A in the center of the perforation line 14 to separate the bag being dispensed from the roll. Ordinarily, none of the plies would be separated from the roll until the user actually pulls on the bag causing the tongue to separate the bag from the roll.

In accordance with this embodiment of the invention, a friction wheel 208 is mounted in the side walls of the dispenser just in front of the finger 204 with its lower surface slightly below the upper surface of the finger 204. The friction wheel 208 does not rotate but is positioned to apply sufficient pressure to the film such that as the consumer pulls on a bag, the friction applied by the wheel 208, causes the upper layer of the film to separate along the perforation line before the bag is actually separated from the roll of bags. Because, in this case, the upper layer is completely detached prior to separation, the effect is the same as if the bags had been provided with the upper layer preseparated; that is, when the bag is removed, the bag will be partially opened.

While the invention has been described with reference to a web of bags of eight layers of plastic material, there can be a lesser or greater number of layers. Also, the layers can be of plastic or other material such as paper, or a combination of plastic and paper. Moreover, it is not necessary that the entire separation line be opened to achieve the desired results. So long as the separation line in an outer layer is detached beyond the slot 14A, some benefit will be achieved although it is preferred that substantially the entire separation line 14 be opened.

While the invention has been particularly shown and described with reference to the preferred embodiments thereof, it will be understood by those skilled in the art that various changes in form and detail may be made without departing from the spirit and scope of the invention.

I claim:

1. A method of manufacturing a roll of self opening plastic bags for use in dispensers which dispense empty bags one at a time, comprising the steps of forming a fully gusseted tubular plastic web, folding the web to form a multi-layer, star sealed web, forming a series of close spaced seal lines and separation lines in the star sealed web to separate it into a multiplicity of individual bags, with each seal line forming the bottom of a bag and its close spaced separation line forming an open top of an adjacent bag when the bags are separated at the separation line, wherein each separation line includes a central slot for engaging a separating tongue in a dispenser, at least partially separating the separation lines in one of the outer layers of the multi-layer star sealed configuration without opening any bags, and rolling the web into a roll whereby each seal line is in front of its corresponding close spaced separation line on the roll so that as the bags are dispensed from the roll, the separation of the leading bag from the roll by engagement of the separating tongue and central slot causes the next leading bag on the roll to open partially with its open end in front.

2. A method of manufacturing a roll of self opening plastic bags according to claim 1, wherein said separation lines are partially opened by applying a force to said one outer layer on one side of each separation line as the web is moving.

3. A method of manufacturing a roll of self opening plastic bags according to claim 2, wherein said force is applied by intermittently moving a member into contact with said one outer layer.

4. A method of manufacturing a roll of self opening plastic bags for use in dispensers which dispense empty bags one at a time, comprising the steps of forming a multi-layer gusseted tubular plastic web, forming a series of close spaced seal lines and separation lines in the web to separate it into a multiplicity of individual bags, each separation line including a central slot for engaging a separating tongue, at least partially separating the separation lines in one of the outer layers of the multi-layer web without opening any bags, and rolling the web into a roll whereby each seal line is in front of its corresponding close spaced separation line on the roll so that as the bags are dispensed from the roll, the separation of the leading bag from the roll by engagement of the separating tongue and central slot causes the next leading bag on the roll to open partially with its open end in front.

5. A method of manufacturing a roll of self opening plastic bags according to claim 4, wherein said separation lines are partially opened by applying a force to said one outer layer on one side of each separation line as the web is moving.

6. A method of manufacturing a roll of self opening plastic bags according to claim 5, wherein said force is applied by intermittently moving a member into contact with said one outer layer.

* * * * *